United States Patent [19]

Carswell

[11] 3,992,731

[45] Nov. 23, 1976

[54] ELECTRIC BABY ROCKER

[76] Inventor: James Carswell, 809 N. 20th St., Fort Pierce, Fla. 33450

[22] Filed: Oct. 17, 1975

[21] Appl. No.: 623,556

[52] U.S. Cl. ..... 5/109; 5/108

[51] Int. Cl.[2] ..... A47D 9/02

[58] Field of Search ..... 5/104, 105, 108, 109

[56] References Cited

UNITED STATES PATENTS

| | | | |
|---|---|---|---|
| 2,570,676 | 10/1951 | Henderson | 5/109 |
| 2,884,651 | 5/1959 | Garey | 5/109 |
| 3,769,641 | 11/1973 | Harper et al. | 5/109 |
| 3,806,966 | 4/1974 | Thompson | 5/109 |

*Primary Examiner*—Casmir A. Nunberg

[57] ABSTRACT

This device consists primarily of a hollow and portable base in which is secured an electric motor and attached, speed reducer, which by articulating rod means will oscillate from front to rear, a carriage in which the baby is placed. The carriage of the device depends from pivotable link rods secured to tubular rails fastened fixedly within the base portion of the device.

2 Claims, 4 Drawing Figures

ELECTRIC BABY ROCKER

This invention relates to sleeping cribs for babies, and more particularly to an electric baby rocker.

It is therefore the principal object of this invention to provide an electric rocker which will gently rock a baby to sleep.

Another object of this invention is to provide a baby rocker which will rock the suspended carriage portion from the front to the rear within the base, rather than from side to side.

Another object of this invention is to provide a rocker of the type described, which will depend from pivotable rod members secured to tubular rail members which will be fixedly secured to and above the opening within the base portion of the rocker.

A further object of this invention is to provide a rocker of the type described, which by motor and speed reducer means, will rock the carriage portion with rod means secured to offset arm means of the speed reducer and rod means secured to a lug on the bottom at one end of the carriage member.

A still further object of this invention is to provide a rocker of the type described, which will have switch means for operating the circuit of the rocker and the base portion will include legs having caster means so as to easily move the rocker about.

Other objects of the invention are to provide an electric baby rocker, which is simple in design, inexpensive to manufacture, rugged in construction, easy to use and efficient in operation.

These and other objects will be readily evident upon a study of the following specification and the accompanying drawing, wherein.

Figure 1:
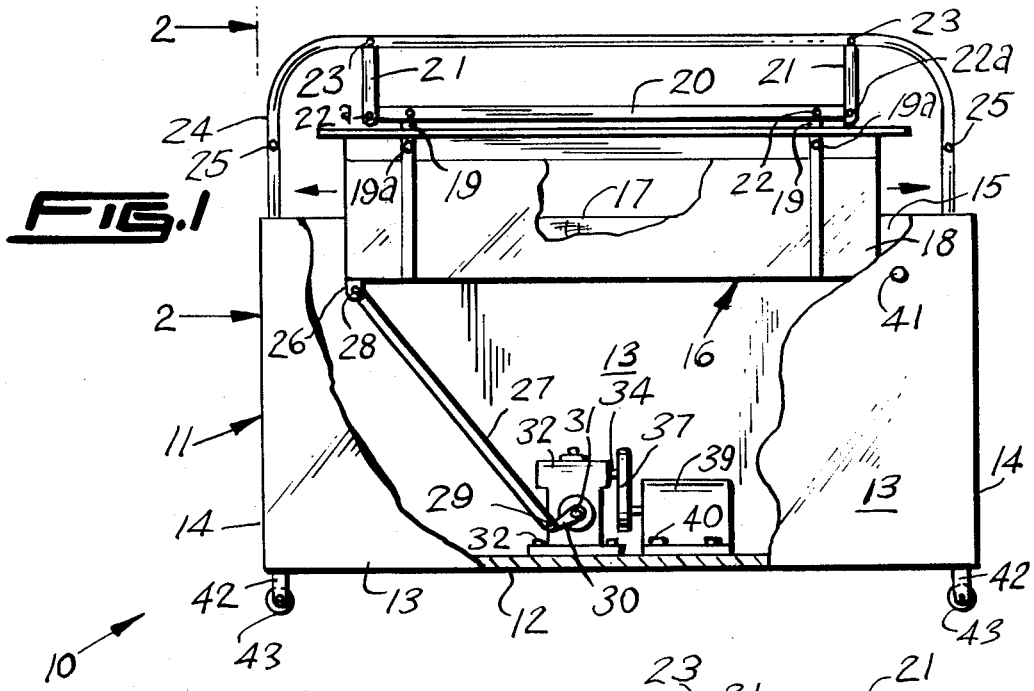
FIG. 1 is a side view of the present invention shown in elevation, and partly broken away, exposing the carriage and sway mechanism.
Figure 2:
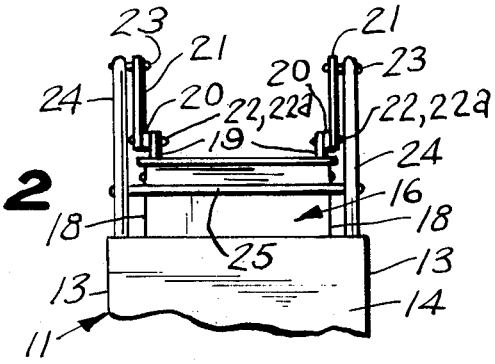
FIG. 2 is a view taken along the line 2—2 of FIG. 1.
Figure 3:
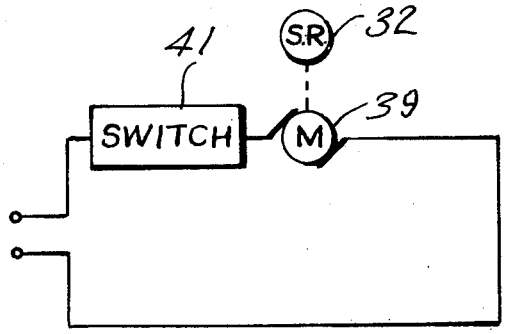
FIG. 3 is a schematic wiring diagram of the invention.
Figure 4:
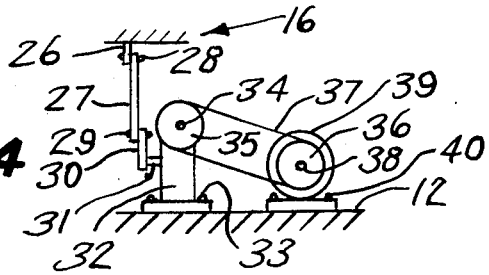
FIG. 4 is a diagrammatic side view of the operating mechanism of the invention, shown in elevation.

According to this invention, an electric baby rocker 10 is shown to include a rectangular configurated bottom wall 12 which is fixedly secured in a suitable manner to the parallel spaced apart side walls 13 and parallel spaced apart end walls 14. The opening 15 receives freely therein, a carriage 16 having a mattress 17. To the side walls 18 of carriage 16, are secured fixedly, a plurality of spaced apart lugs 19 which are rendered secure by means of suitable fasteners 19*a*. Lugs 19 are secured at the opposite ends to a pair of parallel spaced apart and elongated rods 20 which are pivotably secured to link rods 21. Fasteners 22 secure lugs 19 fixedly to rods 20 and fasteners 22*a* pivotably secure link rods 21 to rods 20. The opposite ends of link rods 21 are pivotably secured by fasteners 23, to the tubular rails 24, the lower ends of rails 24 being secured fixedly to the interior of the side walls 13 and face 11. A cross bar 25 is secured fixedly between each end of rails 24 so to provide maximum rigidity therefor. A lug 26 secured fixedly to one end of the bottom of carriage 16, is fastened by fastener 28, and 29 to the operating mechanism of rocker 10. The rotating arm 30 secured to shaft 31 of motor 32, is fastened to rod 27 which by articulating motion will cause carriage 16 to sway from front to rear.

Speed reducer 32 is secured to the bottom wall 12 by means of a plurality of suitable fasteners 33. The shaft 34 of speed reducer 32 is secured fixedly to pulley 35 and pulley 36, together with pulley 35, receives belt 37. Pulley 36 is fixedly secured to shaft 38 of motor 39, and motor 39 is secured fixedly to base 12 by a plurality of suitable fasteners 40. Switch 41 provides control of the sway motion and enables rocker 10 to be shut off and on whenever desired.

What I now claim is:

1. A baby rocker comprising in combination:

A. a carriage for containing a baby within;

B. a base, said base mounting rail means which are disposed overhead of the carriage;

C. plural pivotal link rods connecting rail means overhead of the carriage whereby to suspend the carriage for endwise, distortion-free rocking movement of the carriage relative to the base;

D. oscillating motor means on the base and an articulable rod connecting the said motor means to the carriage, whereby upon oscillation of the motor articulating movement is transferred via the rod to the carriage for reciprocable articulation thereof.

2. The apparatus according to claim 1, including cross bars connecting the said respective rail means transversely and at end thereof, whereby to rigidize the said rail means against lateral swaying forces.

* * * * *